United States Patent [19]

Ishikawa et al.

[11] 4,329,968

[45] May 18, 1982

[54] OIL SEPARATING SYSTEM FOR BLOWBY GAS

[75] Inventors: Yoshikazu Ishikawa, Chofu; Masayuki Honma, Tokyo, both of Japan

[73] Assignee: Nissan Motor Co., Ltd., Yokohama, Japan

[21] Appl. No.: 140,327

[22] Filed: Apr. 14, 1980

[30] Foreign Application Priority Data

Apr. 16, 1979 [JP] Japan ..... 54/49306[U]

[51] Int. Cl.[3] ..... F02M 25/06

[52] U.S. Cl. ..... 123/573; 123/41.86; 123/192 R

[58] Field of Search ..... 123/573, 572, 192 R, 123/192 B, 41.86

[56] References Cited

U.S. PATENT DOCUMENTS

| | | | |
|---|---|---|---|
| 1,749,345 | 3/1930 | Hunt | 123/573 |
| 1,826,390 | 10/1931 | Cram | 123/572 |
| 1,950,586 | 3/1934 | Zubaty | 123/572 |
| 3,884,201 | 5/1975 | Cregan | 123/572 |

FOREIGN PATENT DOCUMENTS

| | | | |
|---|---|---|---|
| 415490 | 6/1925 | Fed. Rep. of Germany | 123/572 |
| 1097755 | 1/1961 | Fed. Rep. of Germany | 123/572 |
| 1476036 | 3/1969 | Fed. Rep. of Germany | 123/572 |

*Primary Examiner*—Wendell E. Burns

*Attorney, Agent, or Firm*—Thompson, Birch, Gauthier & Samuels

[57] ABSTRACT

An internal combustion engine equipped with a blowby gas recirculation system is provided with a jackshaft which is driven by a crankshaft and rotatably supported in a crankcase to operate engine accessories. A rotational part of a centrifugal oil separator is securely connected to an end of the jackshaft to be rotatable with the jackshaft, thereby effectively separating engine oil mist from blowby gas which is sucked through the oil separator to an intake manifold.

12 Claims, 8 Drawing Figures

OIL SEPARATING SYSTEM FOR BLOWBY GAS

BACKGROUND OF THE INVENTION

This invention relates, in general, to an oil separating system for separating engine oil mist from blowby gas to be recirculated to an intake system of an internal combustion engine, and more particularly to an oil separator disposed in a crankcase in connection with a jackshaft for operating engine accessories.

It is well known that a modern internal combustion engine is equipped with a so-called blowby gas recirculation system or positive crankcase ventilation system by which blowby gas having blown into a crankcase, through between a piston and a cylinder wall, is recirculated back to a combustion chamber of the engine through an intake manifold so that the blowby gas is burned in the combustion chamber to prevent air pollution. As apparent, the crankcase is filled with engine oil mist and accordingly the oil mist is also sucked through an intake passage to the combustion chamber along with the blowby gas. Accordingly, the inner wall surface of the intake passage and the inside of the combustion chamber are soiled with the sucked oil mist, causing increase in engine oil consumption.

In this regard, the oil mist is in general separated from the blowby gas by using the difference in specific gravity between the oil mist and the blowby gas by the following measures: a blowby gas outlet through which blowby gas is taken out from a crankcase is located at a section which is not likely to suck splashed engine oil in the crankcase. Additionally, a relatively large volume of oil separating chamber of an oil separator is disposed at such a section, by which the flow rate of the gas in the oil separating chamber is lowered to prolong the staying time of the gas. Further, a metal mesh or obstruction plates are disposed at a passage communicating the oil separating chamber with the inside of the crankcase.

However, such an oil separator has encountered the following problems: the location of the oil separator is unavoidably decided depending upon the direction of the rotation of the crankshaft. Accordingly, the freedom in selecting the location of the oil separator is restricted by this reason. Additionally, in case where the above-mentioned oil separating chamber is formed integrally with an engine body, the oil separator which is restricted in selecting its location is disadvantageous from the standpoints of obtaining suitable spaces in an engine room, decreasing engine weight, and facilitating production or casting of the engine. In other words, depending upon engine types, it may become necessary to locate the oil separating chamber of the oil separator at the opposite side to an intake manifold relative to the axis of the engine body. This requires an extremely long suction pipe through which the blowby gas is recirculated to the intake manifold, raising the problems to increase cost and weight and deteriorating appearance of the engine. Additionally, if a large volume of separating chamber is formed at the same side as the intake manifold relative to the axis of the engine body, there rises an apprehension to make difficult the installation of an exhaust gas treating device such as a catalytic converter or a thermal reactor.

SUMMARY OF THE INVENTION

In view of the above, the present invention has been envisaged by the inventors whose attentions have been directed to the fact that a jackshaft for operating engine accessories is located at the same side as an intake manifold relative to the axis of an engine body. According to the present invention, in a blowby gas recirculation system of an internal combustion engine having a jackshaft rotatably supported in a crankcase to operate engine accessories, a rotational part of an oil separator is operatively connected to an end of the jackshaft to be rotatable with the rotation of the jackshaft, whereby engine oil mist can be effectively separated from the blowby gas to be sucked into an intake system, by the action of centrifugal force generated by the rotation of the rotational part of the oil separator.

A main object of the present invention is to provide an improved oil separating system for blowby gas of an internal combustion engine, which is excellent in oil mist separating function, reducing its cost, and the space required for its installation, and improving its productivety.

Another object of the present invention is to provide an improved oil separating system for blowby gas of an internal combustion engine, which does not restrict the locations and the dimensions of other devices mounted on the outside of an engine body.

A further object of the present invention is to provide an improved oil separating system for blowby gas, by which it becomes unnecessary to form a particular oil separating chamber on the outside of an engine body, for separating engine oil mist from the blowby gas to be sucked to an intake manifold.

A still further object of the present invention is to provide an improved oil separating system for blowby gas of an internal combustion engine, which is composed of a centrifugal oil separator whose rotational part is securely connected to an end of a jackshaft which is rotatably supported in a crankcase of the engine.

Other objects, features and advantages of the improved oil separating system according to the present invention will become more apparent from the following description when taken in conjunction with the accompanying drawings in which like reference numerals designate like parts and elements.

DETAILED DESCRIPTION OF THE PREFERRED EMBODIMENTS

Figure 1:
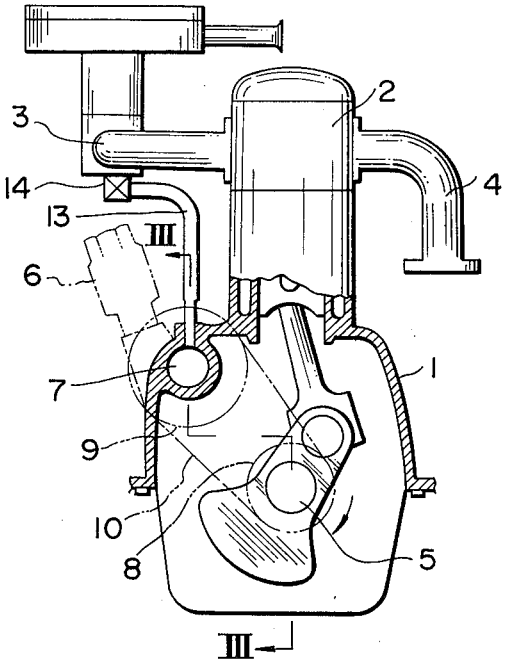
FIG. 1 is a vertical sectional view of an internal combustion engine which is equipped with an oil separating system in accordance with the present invention.
Figure 2:
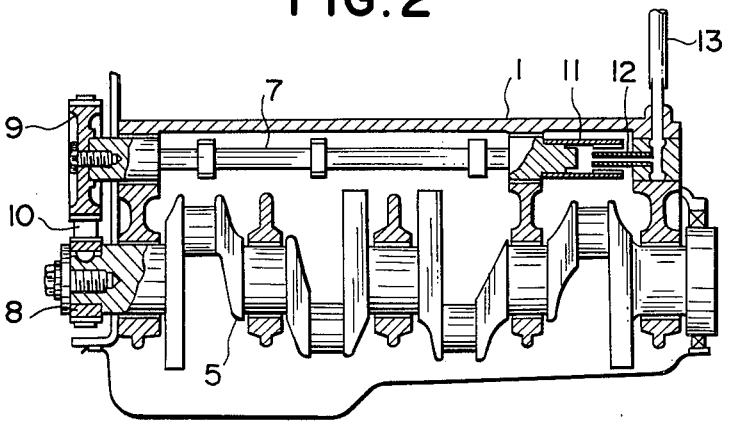
FIG. 2 is a cross-sectional view taken in the direction of arrows substantially along the line III—III of FIG. 1.

Referring now to FIGS. 1 and 2 of the drawings, there is shown an embodiment of an oil separating system according to the present invention is shown as incorporated with an internal combustion engine which is, for example, used in an automotive vehicle. The engine comprises a cylinder block 1 and a cylinder head 2 which is securely mounted on the cylinder block 1. The cylinder head 2 is provided at its one side surface with an intake manifold 3 and at its another opposite side surface with an exhaust manifold 4. A crankshaft 5 is rotatably supported in a crankcase (no numeral) formed at the lower section of the cylinder block 1.

Supported at the same side as the intake manifold 3 relative to the axis (not identified) of the engine is a jackshaft or countershaft 7 which operates engine accessories such as a distributor 6, an oil pump (not shown), a fuel pump (not shown) etc. The jackshaft 7 is driveably connected at its one end with the crankshaft 5 through a timing chain 10 which connects two timing gears 8 and 9 which are secured to the crankshaft 5 and the jackshaft 7, respectively. The driveable connection between the crankshaft 5 and the jackshaft 7 may be made by other suitable means.

Figure 3:
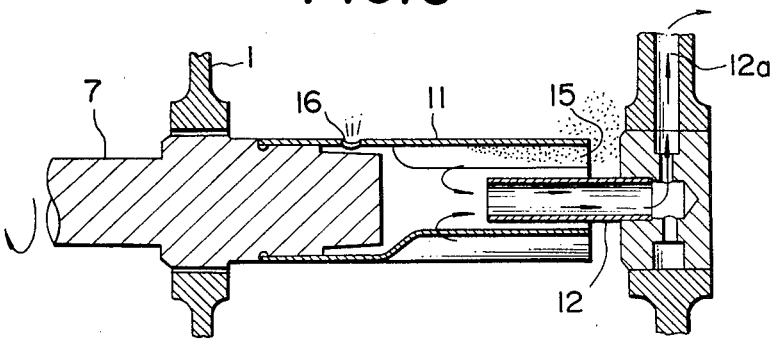
FIG. 3 is an enlarged vertical sectional view showing an essential part of the oil separating system of FIG. 1.
Figure 4:
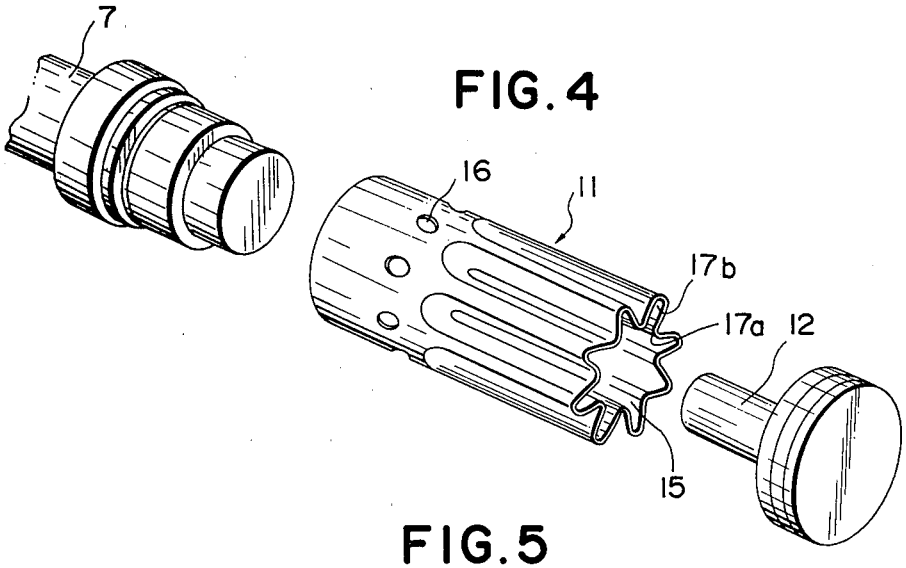
FIG. 4 is an enlarged perspective view of the essential part of FIG. 3, showing an example of a rotatable cylindrical member of the oil separating system according to the present invention.

As shown in FIGS. 2, 3 and 4, a movable cylindrical member 11 is securely connected to another end of the jackshaft 7 so that the cylindrical member 11 and the jackshaft 7 are coaxial with each other. The cylindrical member 11 is rotatable with the rotation of jackshaft 7 and forms a part of an oil separator for separating engine oil mist from blowby gas recirculated back to combustion chambers (not shown) of the engine through the intake manifold 3.

A collector pipe 12 secured to an inner wall of the cylinder block 1 is so provided that its open end is disposed in the bore of the cylindrical member 11. The pipe 12 is fluidly connected through a passage **12*a* to a suction pipe 13 which is in turn fluidly connected to a metering valve 14 which is called PCV (Positive Crankcase Ventilation) Valve. The suction pipe 13 is fluidly connectable through the metering valve 14 with the intake manifold 3**, and forms part of a blowby gas recirculation system or positive crankcase ventilation system.

As illustrated, the cylindrical member 11 is formed with an open end 15 through which the collector pipe 12 extends into the bore of the cylindrical member 11, and another open end which is securely connected to the end of the jackshaft 7. The cylindrical member 11 is formed with a plurality of openings 16 which are radially and outwardly and formed and arranged along the circumference of cylindrical member. The openings 16 are located relatively near the end of the cylindrical member, connected to the jackshaft 7. It will be understood that the inside or bore of the cylindrical member 11 is in communication with the crankcase through the open end 15 and openings 16. It will be noted that the collector pipe 12 is so located that its open end is positioned approximately at the center between the open end 15 and the openings 16 in the axial direction of the cylindrical member 11. The cylindrical member 11 is formed at its inner surface with a plurality of ridges **17*a* and grooves 17*b* which extend in the axial direction of the cylindrical member 11 as clearly shown in FIG. 4**.

With the thus arranged oil separating system, when the crankshaft 5 is rotated upon engine running, the jackshaft 7 is also rotated in synchronism with the rotation of the crankshaft 5. At this time, a vacuum is developed in the intake manifold 3 and therefore the blowby gas, blown out through between a piston (no numeral) and a cylinder wall (no numeral) into the crankcase, is sucked into the cylindrical member 11 so as to be recirculated back to the intake manifold 3 through the collector pipe 12 and the suction pipe 13. It will be understood that engine oil mist present in the crankcase is also sucked with the blowby gas into the bore of the cylindrical member 11.

Under such a condition, the cylindrical member 11 is rotated by the jackshaft 7 so as to rotate the blowby gas and oil mist simultaneously with the assistance of the ridges **17*a* and grooves 17*b* formed on the inner surface of the cylindrical member 11. At this moment, a centrifugal force is given to the blowby gas and the oil mist which flow toward the open end of the collector pipe 12. As a result, oil mist which is relatively high in specific gravity and the blowby gas which is relatively low in specific gravity are separated from each other so that the oil mist is gathered at the inner circumferential section of the inside of the cylindrical member whereas the blowby gas is gathered near the center axis (not indentified) of the cylindrical member 11. Accordingly, only the blowby gas flows into the collector pipe 12. On the contrary, the oil mist gathered on the circumferential section of the inside of the cylindrical member 11 is then attached on the inner surface of the cylindrical member 11 to be condensed or liquefied, and thereafter discharged to the crankcase through the open end 15 and the openings 16 of the cylindrical member 11**.

Figure 5:
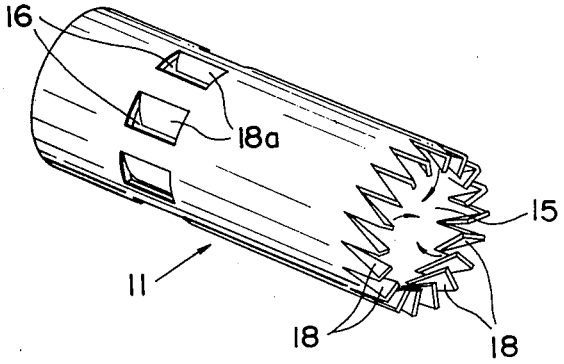
FIG. 5 is an enlarged perspective view of another example of the rotatable cylindrical member of the oil separating system according to the present invention.

In order to positively achieve the blowby gas to flow into the cylindrical member 11, a plurality of vanes 18 as shown in FIG. 5 are formed at the open end 15 of the cylindrical member 11. It is to be noted that the vanes 18 are so arranged as to cause the blowby gas to be sucked into the cylindrical member 11 in addition to providing a rotational movement on the blowby gas to be sucked into the cylindrical member 11. As indicated in FIG. 5, a plurality of vanes **18*a* are secured to the inner surface of the cylindrical member 11 and adjacent to the openings 16, respectively. These vanes also functions the same as the vanes 18**.

Figure 6:
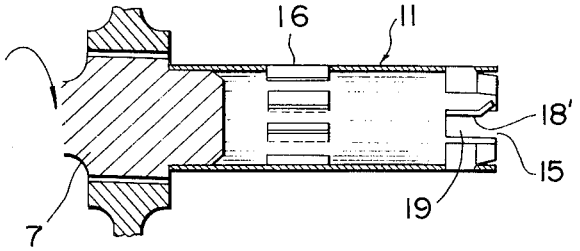
FIG. 6 is an enlarged vertical sectional view showing a further example of the rotatable cylindrical member of the oil separating system according to the present invention.
Figure 7:
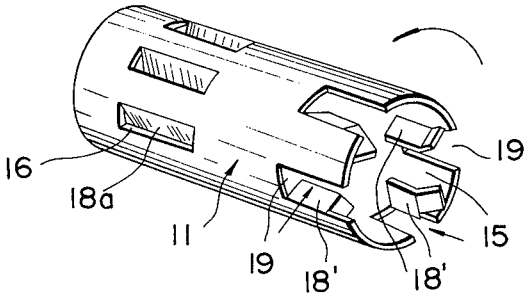
FIG. 7 is a perspective view of the rotatable cylindrical member of FIG. 6.

FIGS. 6 and 7 shows another shape of vanes 18' each of which is formed by cutting out an end section containing the open end 15 of the cylindrical member 11 so as to form a rectangular opening 19 leaving a rectangular portion (18') attached and integral with the body of the cylindrical member 11. Then, the rectangular portion is bent inwardly and its one end is further bent generally in the rotational direction of the cylindrical member 11 as indicated by an arrow in FIG. 7. It will be understood that the vanes 18' indicated in FIGS. 6 and 7 also function the same as the vanes 18 indicated in FIG. 5.

Figure 8:
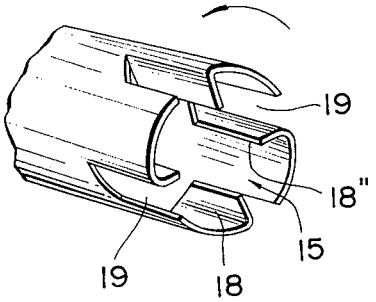
FIG. 8 is an enlarged perspective view of a part of a still further example of the rotatable cylindrical member of the oil separating system according to the present invention.

Otherwise, the open end 15 of the cylindrical member 11 may be formed with vanes as shown in FIG. 8 in which each vane 18" is formed straight elongate along the longitudinal axis of the cylindrical member 11.

While particular constructions of the oil separators have been shown and described with reference to FIGS. 2 to 8, the construction of oil separator is not limited to them and accordingly other types of centrifugal oil separators may be used for the same purpose.

As appreciated from the above explanation, according to the present invention, a rotational part of a centrifugal oil separator is installed on a jackshaft rotatably supported in a crankcase of an engine and therefore it is not necessary to form a large volume of oil separating chamber on the outside of the crankcase which chamber is used in a conventional oil separator. This reduces the cost and weight and the space for installation of the oil separator for separating oil mist from blowby gas. Additionally, since the jackshaft is in general located at the same side as an intake manifold relative to the axis of the engine, a suction pipe for connecting the oil separator and the intake manifold is extremely shortened, making possible a compact arrangement within an engine room. Furthermore, since the oil separating function of the oil separator does not largely depend on the rotatable direction of a crankshaft, i.e., the direction in which engine oil splashed in the crankcase, the location of the oil separator can be selected regardless of the rotational direction of the crankshaft.

What is claimed is:

1. An oil separating system for blowby gas to be recirculated to an intake system of an internal combustion engine having a crankcase, comprising in combination:

a jackshaft disposed in the crankcase to operate engine accessories, said jackshaft being driveably connected at its one end with a crankshaft; and an oil separator through which passes the blowby gas recirculated to the intake system, a part of said oil separator being securely connected to another end of said jackshaft to be rotatable so as to separate engine oil mist from blowby gas to be recirculated to the intake system, by the action of centrifugal force developed by the rotation thereof with the rotation of said jackshaft.

2. An oil separating system for blowby gas to be recirculated to an intake system of an internal combustion engine having a crankcase, comprising:

a jackshaft for operating engine accessories, whose at least a part is located in the crankcase, said jackshaft being driveably connected at its one end with a crankshaft;

a rotatable cylindrical member securely connected to another end of said jackshaft to be rotatable with the rotation of said jackshaft, said rotatable cylindrical member forming part of an oil separator for separating engine oil mist from the blowby gas to be recirculated therethrough into the intake system; and a pipe member disposed in a bore of said cylindrical member to be separate from the inner surface of said cylindrical member, said pipe member being secured to a wall defining the crankcase and fluidly connected to the intake system, an open end of said pipe member being located separate from a first open end of said cylindrical member so that the communication between the inside of the crankcase and the bore of said cylindrical member is established at a location far from the open end of said pipe member.

3. An oil separating system as claimed in claim 2, in which said cylindrical member and said pipe member are arranged coaxial with each other.

4. An oil separating system as claimed in claim 2, in which said cylindrical member is formed with a second open end which is opposite to said first open end, said rotatable cylindrical member being securely connected at the second open end with said another end of said jackshaft.

5. An oil separating system as claimed in claim 4, in which said cylindrical member is formed with a plurality of blowby gas introduction openings which are located far from said first open end thereof.

6. An oil separating system as claimed in claim 5, in which said pipe member is so located that the open end of said pipe member is positioned approximately at the center of the first open end and said blowby gas introduction openings of said cylindrical member in the axial direction of said cylindrical member.

7. An oil separating system as claimed in claim 5, in which said cylindrical member is provided first means for rotating blowby gas sucked into the bore of said cylindrical member with the rotation of said cylindrical member.

8. An oil separating system as claimed in claim 7, in which said first means includes a plurality of ridges and grooves which are formed at the inner surface of said cylindrical member and extend in the axial direction of said cylindrical member.

9. An oil separating system as claimed in claim 7, in which said first means includes a plurality of vanes formed at an open end section of said cylindrical member containing the first end, each of said vanes being straight elongate along the longitudinal axis of said cylindrical member.

10. An oil separating system as claimed in claim 7, in which said cylindrical member is further provided with second means for promoting a sucking action to the blowby gas present in the crankcase, into the bore of said cylindrical member.

11. An oil separating system as claimed in claim 10, in which said first and second means includes a plurality of vanes formed at an open end section of said rotatable cylindrical member containing the first end.

12. An oil separating system as claimed in claim 11, in which first and second means includes a plurality of vanes each of which is secured to the inner surface of said rotatable cylindrical member and adjacent to each blowby gas introduction opening.

* * * * *

UNITED STATES PATENT AND TRADEMARK OFFICE

CERTIFICATE OF CORRECTION

PATENT NO. : 4,329,968

DATED : May 18, 1982

INVENTOR(S) : Ishikawa et al

It is certified that error appears in the above-identified patent and that said Letters Patent are hereby corrected as shown below:

Column 1, line 7, cancel "an" and insert --the--

Column 1, line 11, cancel "It is well known that a modern" and insert --A conventional--

Column 1, line 15, after "through", insert --the space--

Column 1, line 24, cancel "soiled" and insert --fouled--

Column 1, line 26, cancel "regard" and insert --conventional arrangement--

Column 1, line 26, cancel "in general" and insert --substantially--

Column 1, line 33, cancel "of" first occurrence

Column 1, lines 35-36, cancel "prolong the staying time" and insert --delay the outflow--

Column 1, line 37, cancel"at" and insert --in--

Column 1, line 40, cancel "an" and insert --a conventional--

Column 1, line 42, cancel "unavoidably decided depending upon" and insert --determined by--

Column 1, line 45, cancel "case" and insert --cases--

Column 1, line 47, cancel "an" and insert --the--

Column 1, line 48, cancel "is restricted in selecting its location is disadvantageous" and insert --has a limited number of possible locations presents problems--

Column 1, line 32, cancel "volume".

UNITED STATES PATENT AND TRADEMARK OFFICE

CERTIFICATE OF CORRECTION

PATENT NO. : 4,329,968

DATED : May 18, 1982

INVENTOR(S) : Ishikawa et al

It is certified that error appears in the above-identified patent and that said Letters Patent are hereby corrected as shown below:

Column 1, lines 49-50, cancel "obtaining suitable spaces in an engine room" and insert --finding a suitable location in the engine compartment--

Column 1, line 54, cancel "at" and insert --on--

Column 1, line 54, cancel "to an" and insert --of the--

Column 1, lines 57-58, cancel "raising the problems to increase" and insert --creating the problems of increased--

Column 1, line 59, after volume, cancel "of"

Column 1, line 60, cancel "formed at" and insert --provided on--

Column 1, lines 61-62, cancel "there rises an apprehension to make difficult the installation of" and insert --it is difficult to install--

Column 2, line 2, cancel "at" and insert --on--

Column 2, lines 17-19, cancel "reducing its cost, and the space required for its installation, and improving its productivety" and insert --reduces costs, and reduces space requirements--

Column 2, lines 23-24, cancel "the locations and the dimensions" and insert --available locations and the dimensions--

Column 2, lines 26-27, cancel "by which it becomes unnecessary to form a particular" and insert --in which it is unnecessary to provide an--

UNITED STATES PATENT AND TRADEMARK OFFICE

CERTIFICATE OF CORRECTION

PATENT NO. : 4,329,968

DATED : May 18, 1982

INVENTOR(S) : Ishikawa et al

It is certified that error appears in the above--identified patent and that said Letters Patent are hereby corrected as shown below:

Column 3, line 8, before "according", insert --which--

Column 3, line 14, cancel "another"

Column 3, line 16, after "crankshaft", insert --bearing--

Column 3, line 23, cancel "its one end with" and insert --one of its ends to--

Column 3, line 30, cancel "another" and insert --the other--

Column 3, line 43, after "called", insert --a--

Column 3, line 44, cancel "Valve" and insert --valve--

Column 3, line 45, cancel "connectable" and insert --connected--

Column 3, line 45, cancel "with" and insert --to--

Column 3, line 55, after "outwardly", cancel "and"

Column 3, line 56, after "circumference of", insert "the"

Column 3, line 58, after "member", insert --which is--

Column 3, line 68, after "member 11 as", insert --is--

Column 4, line 2, cancel "upon" and insert --during--

Column 4, line 6, after "through", insert --the space--

Column 4, line 36, cancel "achieve" and insert --urge--

Column 4, line 42, cancel "on" and insert --to--

Column 4, line 43, cancel "indicated" and insert --also shown--

Column 4, line 45, cancel "and"

UNITED STATES PATENT AND TRADEMARK OFFICE

CERTIFICATE OF CORRECTION

PATENT NO. : 4,329,968

DATED : May 18, 1982

INVENTOR(S) : Ishikawa et al

It is certified that error appears in the above-identified patent and that said Letters Patent are hereby corrected as shown below:

Column 4, lines 46-47, cancel "16, respectively. These vanes also functions the same" and insert --16. Vanes 18a function in the same manner--

Column 4, line 48, cancel "shows" and insert --show--

Column 4, line 62, cancel "along" and insert --parallel to--

Column 4, line 66, after "of", insert --the--

Column 5, line 5, cancel "form" and insert --provide--

Column 5, line 5, cancel "of"

Column 5, line 7, cancel "in" and insert --as--

Column 5, line 10, cancel "at" and insert --on--

Column 5, line 11, cancel "an" and insert --the--

Column 5, line 13, cancel "shortened" and insert --short--

Column 5, lines 14-15, cancel "an engine room" and insert --the engine compartment--

Column 5, line 17, cancel "rotatable" and insert --rotational--

Column 5, line 17, cancel "a" and insert --the--

Column 5, line 18, cancel "splahsed" and insert --splashes--

UNITED STATES PATENT AND TRADEMARK OFFICE

CERTIFICATE OF CORRECTION

PATENT NO. : 4,329,968

DATED : May 18, 1982

INVENTOR(S) : Ishikawa et al

It is certified that error appears in the above-identified patent and that said Letters Patent are hereby corrected as shown below:

The Claims should read as follows:

1. An oil separating system for blowby gas to be recirculated to an intake system of an internal combustion engine having a crankcase, comprising:

a jackshaft disposed in the crankcase to operate engine accessories, said jackshaft being driveably connected at its one end to a crankshaft; and an oil separator through which the blowby gas is recirculated to the intake system, a part of said oil separator being securely and rotatably connected to the other end of said jackshaft to separate engine oil mist from blowby gas by the action of centrifugal force developed by the rotation thereof with the rotation of said jackshaft.

2. An oil separating system for blowby gas to be recirculated to an intake system of an internal combustion engine having a crankcase, comprising:

a jackshaft for operating engine accessories, at least a part of said jackshaft being located in the crankcase, said jackshaft being driveably connected at one end to a crankshaft;

It is certified that error appears in the above-identified patent and that said Letters Patent are hereby corrected as shown below:

a rotatable cylindrical member securely and rotatably connected to the other end of said jackshaft, said rotatable cylindrical member forming part of an oil separator for separating engine oil mist from the blowby gas to be recirculated therethrough into the intake system; and a pipe member disposed in a bore of said cylindrical member spaced from the inner surface of said cylindrical member, said pipe member being secured to a wall defining the crankcase and being fluidly connected to the intake system, an open end of said pipe member being spaced inwardly from a first open end of said cylindrical member so that the communication between the inside of the crankcase and the bore of said cylindrical member is established at a location spaced outwardly from the open end of said pipe member.

4. An oil separating system as claimed in Claim 2, in which said cylindrical member is formed with a second open end which is opposite to said first open end, said rotatable cylindrical member being securely connected at said second open end to said other end of said jackshaft.

It is certified that error appears in the above-identified patent and that said Letters Patent are hereby corrected as shown below:

5. On oil separating system as claimed in Claim 4, in which said cylindrical member is formed with a plurality of blowby gas introduction openings which are spaced inwardly from said cylindrical member first open end.

6. An oil separating system as claimed in Claim 5, in which said pipe member is so located that said open end of said pipe member is positioned approximately midway between said cylinder member first open end and said blowby gas introduction openings of said cylindrical member.

7. An oil separating system as claimed in Claim 5, in which said cylindrical member has first means for rotating blowby gas sucked into the bore of said cylindrical member by the rotation of said cylindrical member.

8. An oil separating system as claimed in Claim 7, in which said first means includes a plurality of ridges and a plurality of grooves which are formed at the inner surface of said cylindrical member and which extend in the axial direction of said cylindrical member.

UNITED STATES PATENT AND TRADEMARK OFFICE

CERTIFICATE OF CORRECTION

PATENT NO. : 4,329,968
DATED : May 18, 1982
INVENTOR(S) : Ishikawa et al

It is certified that error appears in the above-identified patent and that said Letters Patent are hereby corrected as shown below:

9. An oil separating system as claimed in Claim 7, in which said first means includes a plurality of vanes formed at said cylindrical member first open end, each of said vanes being straight elongate and parallel to the longitudinal axis of said cylindrical member.

10. An oil separating system as claimed in Claim 7, in which said cylindrical member further has second means for sucking the blowby gas present in the crankcase into the bore of said cylindrical member.

11. An oil separating system as claimed in Claim 10, in which said first and second means include a plurality of vanes formed at said cylindrical member first open end.

UNITED STATES PATENT AND TRADEMARK OFFICE

CERTIFICATE OF CORRECTION

PATENT NO. : 4,329,968

DATED : May 18, 1982

INVENTOR(S) : Ishikawa et al

It is certified that error appears in the above-identified patent and that said Letters Patent are hereby corrected as shown below:

12. An oil separating system as claimed in Claim 11, in which first and second means include a plurality of vanes each of which is secured to the inner surface of said rotatable cylindrical member and located adjacent to each said blowby gas introduction opening.

Signed and Sealed this

*Nineteenth* Day of *April 1983*

[SEAL]

*Attest:*

GERALD J. MOSSINGHOFF

*Attesting Officer*

*Commissioner of Patents and Trademarks*